United States Patent [19]

Sorce

[11] Patent Number: 4,825,564

[45] Date of Patent: May 2, 1989

[54] TEMPORARY COLD WEATHER BOOTS

[76] Inventor: Joan P. Sorce, 15106 Paladora, Houston, Tex. 77083

[21] Appl. No.: 110,113

[22] Filed: Oct. 19, 1987

[51] Int. Cl.[4] ..... A43B 1/14

[52] U.S. Cl. ..... 36/87; 36/7.1 R; 36/9 R; 36/59 R

[58] Field of Search ..... 36/7.1, 7.3, 87, 9 R, 36/9 A, 59 R, 1, 4

[56] References Cited

U.S. PATENT DOCUMENTS

| | | | |
|---|---|---|---|
| 1,644,217 | 10/1927 | Wreford . | |
| 2,924,029 | 2/1960 | Rosen | 36/7.1 R |
| 3,399,329 | 8/1968 | Zimmon | 36/1 X |
| 3,422,550 | 1/1969 | Robinson . | |
| 3,442,034 | 5/1969 | Moore et al. . | |
| 3,684,922 | 8/1972 | Ericson . | |
| 3,981,088 | 9/1976 | Mitchell et al. | 36/87 |
| 4,335,527 | 6/1982 | Pask | 36/7.1 R |
| 4,616,428 | 10/1986 | Leger | 36/7.1 R |

FOREIGN PATENT DOCUMENTS

| | | | |
|---|---|---|---|
| 2317924 | 10/1974 | Fed. Rep. of Germany | 36/7.3 |
| 2329998 | 1/1975 | Fed. Rep. of Germany | 36/7.3 |
| 631632 | 8/1982 | Switzerland | 36/7.1 R |
| 991995 | 2/1983 | U.S.S.R. | 36/59 R |

*Primary Examiner*—James K. Chi

*Attorney, Agent, or Firm*—Russell J. Egan

[57] ABSTRACT

A temporary covering for feet in cold and wet weather conditions is formed by two identical boots each having a pair of foot shaped plastics members sealed together along substantially their entire periphery leaving only foot entry openings. Together the side members define a sole for the boot. Each boot has at least one tie loop with a tie ribbon passing therethrough. Each boot also has an insert member of generally foot shape received in the boot and which, when rotated to lie generally against the sole portion of the boot shapes the boot into wearable condition. Each boot has a plurality of anti-skid strips adhered to the bottom outer surface of the sole portion.

12 Claims, 1 Drawing Sheet

TEMPORARY COLD WEATHER BOOTS

BACKGROUND OF THE INVENTION

1. The Field of the Invention

The present invention pertains to a temporary cold weather boot and in particular a boot which can serve as a temporary replacement for cold weather boots and/or sports shoes and yet be easily carried on one's person, when not in use, without burden to the wearer.

2. The Prior Art

All skiers know how important it is to have the proper boots in order to ski both successfully and safely. However, they also known what a problem it is to get about in these boots when they are not on skis. The normal ski boot is just not designed for comfortable or safe walking. Thus the skier is faced with the problem of what to wear while getting from the transport to the ski area, for example a car, to the ski slope, and what to do when making a temporary call within a ski lodge, etc. One solution to this problem would be to wear another pair of shoes while walking from the car to the lodge, but then there is the problem of what to do with these shoes while skiing. Another solution would be to walk bare footed or in stockinged feet. Obviously neither of these courses of action would be recommended as the ground would most likely be both cold and wet and therefore not the best conditioning for one's feet prior to a day's skiing. Also, floors within ski lodges are often wet from traffic making bare foot or stockinged foot walking inside the lodge undesirable.

It therefor appears that some sort of temporary boot which could be worn during these brief intervals and easily carried while skiing would be in order. However, the choices available from the prior art are not suitable. One could try the disposable slippers of the type used by surgeons, but these are not designed for out-of-doors wear or for walking any distance. They would likely come apart under cold and wet conditions and would not be expected to provide comfort from the cold nor slip or skid protection. Examples of these disposable slippers may be found in U.S. Pat. Nos. 3,442,034 and 3,422,550, the latter being designed as an overshoe or shoe cover. Even covering one's feet with plastic bags would not be solution as such bags are not designed for wear, would not protect from cold, would puncture easily and become slippery when wet. Examples of this type of approach to foot coverings may be found in U.S. Pat. Nos. 3,684,922 and 4,335,527. The former includes a coating of carbon black on the sole portion of the boot for grounding purposes. The latter is an overshoe unsuitable for wear without a shoe or in possibly slippery conditions. Temporary overshoes of different types of materials are represented by U.S. Pat. No. 1,644,217, which discloses a paper overshoe intended to provide cold weather protection but not distance walking, and U.S. Pat. No. 2,924,029, which discloses a plastic overshoe, particularly for high heeled shoes. Neither of these would be suitable as a shoe replacement for walking distances in cold and wet conditions.

The present invention overcomes the deficiencies of the prior art by providing a temporary cold weather boot which will protect the unshod foot, when worn, and yet will be easy to store and carry on one's person, when not in use.

SUMMARY OF THE INVENTION

The present invention is a temporary cold weather boot designed to keep the unshod foot warm and dry and yet be convenient to store on one's person when not in use as a boot. The present invention is formed by a pair of generally foot shaped plastic members joined together along a majority of their peripherys and having a gripping tread material adhered to an outer sole portion thereof, a cushioning insert received therein, and a flexible tie to secure the boot in place. The invention can be conveniently stored by rolling, folding or otherwise compacting the boot to a storable size to be carried in a pocket or the like. When they are to be used, the boots are opened, the inserts rotated to lie flat on the inside of the sole portion, the foot inserted and the ties tied.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
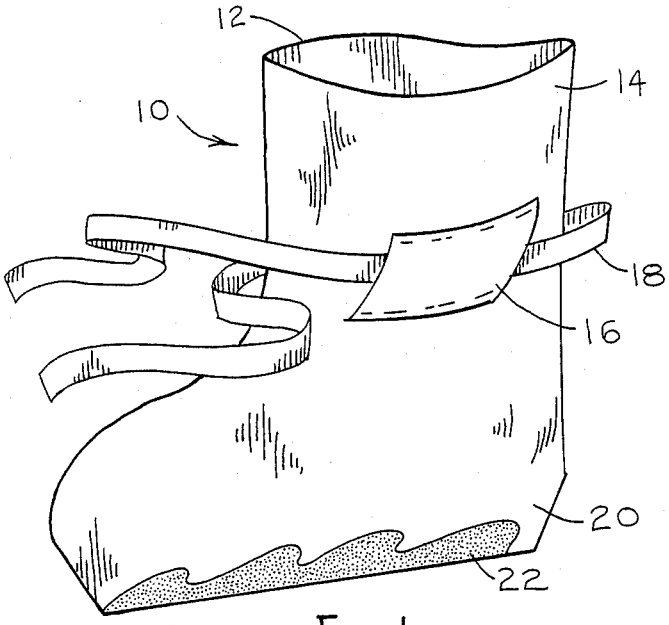
FIG. 1 is a side elevation of one of a pair of temporary cold weather boots according to the present invention.

The present invention is intended as an inexpensive, temporary cold weather boot which can be conveniently carried on one's person when not in use. It has particular use in providing a temporary boot for an unshod foot and is capable of withstanding both cold and wet conditions.

The subject invention comprises a pair of temporary cold weather boots 10 each formed by a pair of mirror image members 12, 14 sealed together along substantially their entire periphery, excluding a foot opening, of course. At least one tie loop 16 is secured to an upper portion of the boot for passage of a tie ribbon 18. A sole portion 20 of the boot has a skid resistant material 22 adhered thereto by adhesive material (not shown) having the ability to withstand both cold and flexing without releasing. Each boot is completed with an insert 24 which serves as an insulating and cushioning pad and as well as a boot shaping member.

Figure 2:
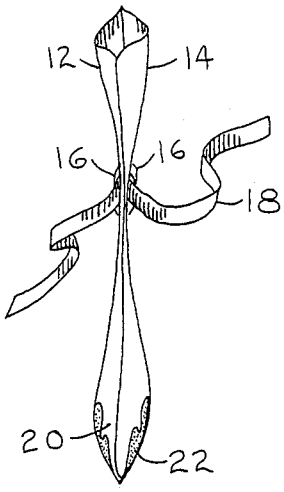
FIG. 2 is a front view of the boot of FIG. 1.
Figure 3:
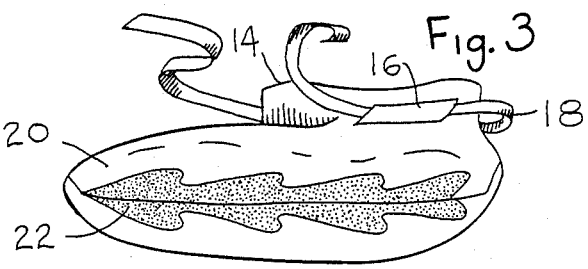
FIG. 3 is a bottom perspective showing the gripping sole portion of the present invention.
Figure 4:
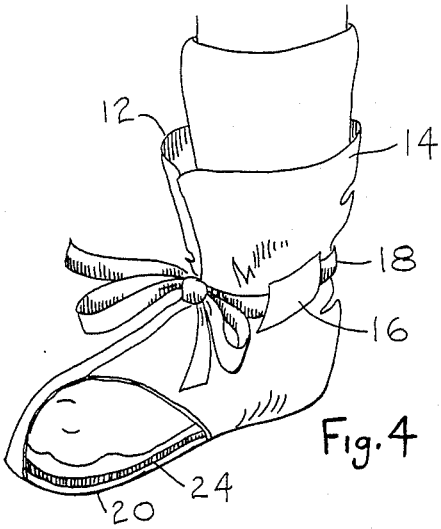
FIG. 4 is a perspective view of the boot opened to receive a foot, with a section of the boot broken away to show the construction.
Figure 5:
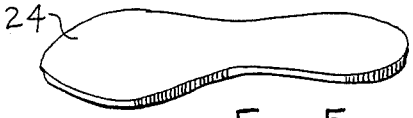
FIG. 5 is a perspective view of an insert for the present invention.

It will be appreciated from FIG. 2 that the subject invention, with the insert 24 relocated to lie parallel to and inbetween the planes of the side members 12, 14, forms a flat package which is convenient for sales display. This profile also allow the boots to be easily stored by simply folding or rolling them up for insertion into a pocket or the like. The boots could also simply be slipped flat between layers of clothing. When it is time to use the boots, they are simply opened, the inserts twisted and fully inserted into the boots to shape them. The feet are inserted and the ties fastened to secure the boots in place.

The temporary cold weather boots of the present invention are preferably formed of at least one layer of durable plastics material, such as 1.5mm polyethylene.

This material can be clear, opaque or translucent, colored, textured or covered with designs and/or logos.

The skid resistant material 22 is preferably a mineral coated general purpose antislip material such as that manufactured by 3M Corporation and widely available. It must be adhered to the boot's sole by an adhesive which will not delaminate when the boot is folded, crushed or rolled up. It must also be able to withstand cold temperatures, at least below freezing, and moisture as the boots are intended specifically for conditions found in areas having snow skiing. It should again be stated that the subject boots are intended as temporary boots for walking in the ski area surrounding the skiing slopes and are not to be used during actual skiing.

The inserts 24 are stamped to have a generally foot shaped outline. They are preferably made from ¼" thick ethifoam. This material has been found to have excellent cushioning and cold insulating properties.

The ties 18 are preferably 2 mm plastic ribbon of sufficient length to effect a tie.

The subject boots would preferably be made in a small range of sizes, as exact fit is not essential. They are not intended as replacements for the traditional apres ski shoes, since these shoes can not be conveniently carried while skiing. Rather the subject boots are intended mostly for wear during short trips in snowy and wet conditions and easily carried on one's person when not being worn. They are made of sufficiently strong material to have a life of at least a ski season and therefor do not fall within the general classification of "disposable".

The present invention can be subject to many changes and modifications without departing from the spirit or essential characteristics of the present invention as set forth in the appended claims.

I claim:

1. A temporary covering for unshod feet in cold and/or wet conditions comprising:

a pair of boots each formed by a pair of mirror image members of substantially uniformly thick material sealed together along substantially their entire periphery leaving only a foot opening to each boot;

each said member defining a sole portion having adhered on the outer side thereof a plurality of antislip members in a patterned array;

each said member having at least one tie loop;

a tie ribbon of sufficient length to secure said boot on a foot passing through each said loop; and an insert member formed from material having both insulating and cushioning properties and cut out to have the general outline of a foot, whereby said boot can be carried and stored in a compact condition with the insert rotated to lie substantially parallel to the planes of the members and opened into usable condition by rotating the insert to lie inside the sole portion thereby to shape the boot.

2. The foot covering according to claim 1 wherein said members define foot and ankle portions and said loops are on said ankle portions.

3. The foot covering according to claim 1 wherein said members are formed from at least one layer of 1.5 mm plastics material.

4. The foot covering according to claim 3 wherein said plastics material is polyethylene.

5. The foot covering according to claim 1 wherein said tie is 2 mm plastic ribbon.

6. The foot covering according to claim 1 wherein said insert is ethifoam.

7. The foot covering according to claim 6 wherein said insert is at least ¼" thick.

8. A pair of boots for use in cold and wet conditions to cover unshod feet, said boots comprising:

a pair of boots each formed by mating side members of substantially uniformly thick material bonded about substantially their entire peripheries leaving only a foot opening, said members each defining foot and ankle portions and together defining a sole portion;

a tie loop secured to each said side member in the ankle portion;

each boot having a tie ribbon passing through boot tie loops;

a plurality of antiskid members adhered to said sole portion in a patterned array; and a foot shaped insert member of insulating and cushioning material in each said boot, each said insert member being movable from a first position substantially parallel to and in between said side members allowing said boots to lie flat and/or to be rolled or folded into a compact unit and a second position lying against said sole portion to shape said boot for receipt of a foot.

9. The pair of boots according to claim 8 wherein said side members are formed from at least one layer of plastics material 1.5 mm thick.

10. The pair of boots according to claim 9 wherein said plastics material is polyethylene.

11. The pair of boots according to claim 8 wherein said insert is ethifoam.

12. The pair of boots according to claim 11 wherein said insert is at least ¼" thick.

* * * * *